US005799947A

United States Patent [19]

Spector

[11] Patent Number: 5,799,947

[45] Date of Patent: Sep. 1, 1998

[54] CARD PLAYING GAME USING STANDARD PLAYING CARDS MIXED WITH PLAYING-PHONE CARDS

[76] Inventor: Donald Spector, 380 Mountain Rd., Union City, N.J. 07080

[21] Appl. No.: 884,886

[22] Filed: Jun. 30, 1997

[51] Int. Cl.[6] ..... A63F 1/00

[52] U.S. Cl. ..... 273/304

[58] Field of Search ..... 273/292, 297, 273/303, 304, 306

[56] References Cited

U.S. PATENT DOCUMENTS

| | | | |
|---|---|---|---|
| 516,887 | 3/1894 | Cole | 273/304 |
| 2,133,746 | 10/1938 | Hawgood | 273/304 |
| 2,251,781 | 8/1941 | Comens | 273/304 X |
| 5,169,155 | 12/1992 | Soules et al. | 273/304 X |
| 5,632,489 | 5/1997 | Rozzi, Sr. et al. | 273/304 |

*Primary Examiner*—William E. Stoll
*Attorney, Agent, or Firm*—Michael Ebert

[57] ABSTRACT

A playing card game whose winner gains free phone calling time for a period that depends on the value of playing-phone cards he has won. The game uses two decks of playing cards, one being a standard deck of 52 cards divided into four suits (hearts, diamonds, clubs and spades), each suit having king, queen and jack cards and ten numeric cards (Ace to 10). The other deck is a hybrid standard deck in which each of the cards is integrated with a prepaid phone card having a specified money value which depends on the rank of the card and fixes the free phone calling time accorded to its holder, whereby each hybrid card is a playing-phone card. The game is played with the standard deck, some of whose cards are replaced by corresponding playing-phone cards taken from the hybrid deck. After a game is played, the winner keeps the playing-phone cards included in his winning hand and is thereby rewarded for having won.

8 Claims, 1 Drawing Sheet

CARD PLAYING GAME USING STANDARD PLAYING CARDS MIXED WITH PLAYING-PHONE CARDS

BACKGROUND OF THE INVENTION

1. Field of Invention

This invention relates generally to games played with playing cards, and some particularly to a game played with a standard deck of playing cards some of whose cards have been replaced with corresponding playing-phone cards taken from a hybrid deck whereby the winner of the game keeps the playing-phone cards in his winning hand and is thereby rewarded by being given free phone time for a period that depends on the value of these playing-phone cards.

2. Status of Prior Art

A standard deck of playing cards used in playing various games of chance or skill consists of 52 cards. The deck is divided into four "suits" (hearts, diamonds, clubs and spades). In each of these suits there are king, queen and jack cards as well as ten cards bearing numeric "pips" (Ace to 10). In a gambling game, there is often an extra card called the joker. Gambling games, such as Poker, Pinochle and Casino, are either played for money or for chips purchased from the game's banker.

It takes a fair degree of skill and experience to play many card games effectively, and it is therefore gratifying to a skillful player to beat his opponents. But what mainly lends excitement and zest to a card game is the possibility of winning money or other valuables.

Card playing is therefore a form of gambling, an activity that is considered by many to be immoral, if not illegal. In England and in the United States, before statutes were enacted making it unlawful, gambling was not considered a common law crime as long as it was conducted privately. But currently in the United States, state statutes govern gambling's legality, and while some states prohibit all forms of gambling by minors, others allow wagering up to certain amounts.

But regardless of whether gambling is illegal in some states and not in others, the prevailing middle class attitude is that gambling is immoral and socially destructive. Children are therefore discouraged from gambling for money lest they be corrupted by this activity, particularly since what little money a child has is derived from an allowance given to him by his parents.

Yet while children enjoy competitive card games, should the game not reward its winner in some way, it would lose its appeal. It is as if a child were to play a game of marbles and the child who won the game did not in doing so acquire the marbles of the losing child. A game which does not reward its winner may be "friendly" but it is also pointless since the winner gains nothing of value.

To avoid gambling, it is the practice for children to play card games using as a surrogate for real money, toothpicks or match sticks. However, this deprives the game of all excitement, and children therefore sometimes make use as playing chips, baseball cards or other items children are prone to trade. But the problem with baseball cards is that their value is uncertain. Thus a Lou Gehrig card, when originally issued, may have been worth 50 cents, whereas in the current market its value may be over a hundred dollars.

Inasmuch as in a game in accordance with the invention, use is made of playing cards that are a hybrid of a standard playing card and a phone card and have a specified value, it is essential that the nature of phone cards be fully understood.

Children are a major user of phone cards, for they obviate the serious drawbacks of pay telephones. A child who is away from home and wishes to call his parents from a pay telephone must have the coins required for this purpose. Thus if the operator demands that the child deposit 75 cents, the child may not have this amount available. And if the child is able to deposit 75 cents to make a call, a few minutes later the operator will interrupt the call to demand another 75 cents to continue the call, and the child may not have the additional coins. And with out-of-state calls, several dollars in coins may be necessary.

These difficulties are by no means limited to children, for any adult wishing to make a call from a pay telephone in an airport is likely to be frustrated by his inability to satisfy the heavy coin demands of the operator.

The modern phone card renders the pay telephone obsolete and effects substantial savings in telephone costs. A phone card which can be purchased at a newsstand and at various other places has printed on its face a pre-payment amount, such as 5 dollars. This entitles the holder of the cards to 5 dollars worth of calling time.

Printed on the phone card is an 800 toll-free number to be dialed in order to make a call, say 1-800-517-8987. Also printed on the card is the card number. This number (say 8554-265-2665) is entered when prompted by the 800 operator.

After the card number is entered, the holder then dials the party he wishes to call anywhere in the world. At the beginning of each call a voice prompt will announce the balance remaining on the card. Thus if the specified value on the card is 5 dollars, and one makes a call costing 75 cents, then the voice prompt will announce that a balance of $4.25 remains. And the card will also indicate its expiration date, say 04/99.

Thus one who possesses a phone card is given a number unique to that card, and can he make phone calls on any available touch tone phone for a period of time limited by the face value of the card. The current practice is for the system to remind the card holder when he has one minute remaining on his card.

SUMMARY OF INVENTION

In view of the foregoing, the main object of this invention is to provide a card game which does not involve gambling with money, yet rewards the winner in such a way that he is able to enjoy the benefits of winning long after the game is over.

More particularly, an object of this invention is to provide a playing card game in which the winner of the game retains the hybrid cards included in his winning hand, which hybrid cards function as phone cards and afford the winner free calling time to an extent determined by the aggregate money value of the phone cards.

A significant feature of a game in accordance with the invention lies in its suitability for children, for though no money is involved in playing a game, and the game does not constitute a gambling activity, the winner of the game receives free phone calling time which can be used by the child to call his parents and his friends.

Also an object of this invention is to provide a card game which may be played by two or more players using a standard deck of playing cards and following the rules of any traditional game, the winner retaining those cards in his winning hand having a phone card incorporated therein.

Briefly stated, these objects are attained by a playing card game in which the winner gains free phone calling time for a period which depends on the value of the playing-phone cards he has won. The game uses two decks of playing cards, one being a standard deck of 52 cards divided into four suits (hearts, diamonds, clubs and spades), each suit having king, queen and jack cards and ten numeric cards (Ace to 10).

The other deck is a hybrid standard deck in which each of the cards which corresponds to a standard playing card is integrated with a prepaid phone card whose specified money value which fixes the free phone calling time accorded to its holder depends on the rank of the playing card, whereby each hybrid card is a playing-phone card. The game is played with the standard deck, some of whose cards are replaced by corresponding playing-phone cards taken from the hybrid deck. After a game is played, the winner keeps the playing-phone cards included in the winning hand and is thereby rewarded for having won.

BRIEF DESCRIPTION OF DRAWING

For a better understanding of the invention as well as other objects and further features thereof, reference is made to the following detailed description to be read in conjunction with the accompanying drawings, wherein.

DESCRIPTION OF INVENTION

Figure 1:
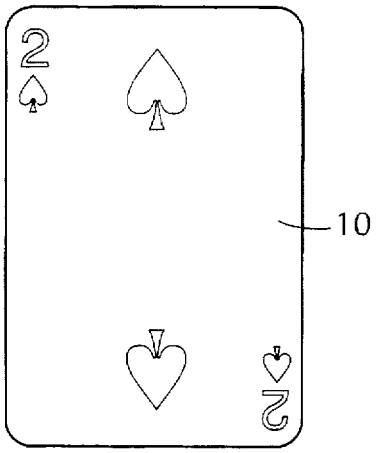
FIG. 1 shows the face of a 2 of spades playing card taken from a standard deck.
Figure 2:
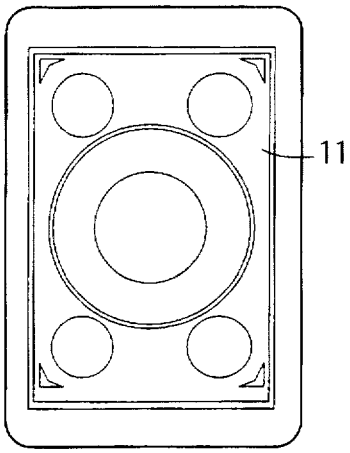
FIG. 2 shows the rear of this card.

Referring now to FIG. 1, shown therein is the face 10 of a card taken from a standard deck of playing cards. The chosen card is a 2 of spades. Printed on the face of this card both at its upper left corner and at its lower right corner is the number 2 adjacent to which is printed the symbol for a spade. Hence regardless of whether the card is held up or down, one is able to identify the card. The rear 11 of the card, as shown in FIG. 2, has a decorative pattern printed thereon; hence it is only the player holding the card and looking at its face who can identify it.

A game in accordance with the invention requires two decks of cards, one deck being a standard pack of 52 cards, one card of which is shown in FIG. 1. The other deck is a hybrid whose nature will later be explained.

In a standard deck of 52 cards for playing such games as Poker, Pinochle and Casino, the deck is divided into four "suits" in which the hearts and diamonds are red in color and the clubs and spades are black. In each of these suits we find king, queen and jack cards, as well as cards bearing numeric "pips" 1 to 10, in which the number 1 is represented by an Ace A card.

Figure 3:
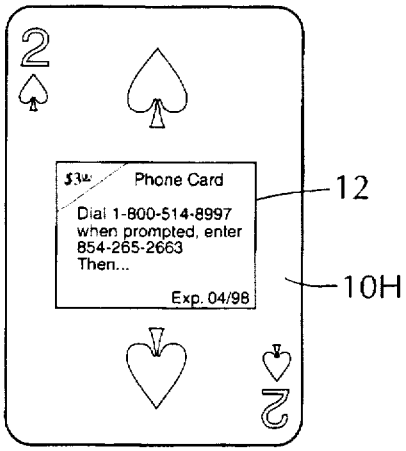
FIG. 3 illustrates the face of a 2 of spades taken from a hybrid deck in which each playing card is integrated with a phone card.

The hybrid deck of cards necessary to a game in accordance with the invention is a standard deck of 52 playing cards, each card of which is integrated with a phone card. Thus FIG. 3 shows the face 10H of a card taken from the hybrid deck which corresponds with the 2 of Clubs card shown in FIG. 1 taken from the standard deck. In practice, the block may be perforated so that the phone-card can be removed from the playing card.

Integrated with the playing card shown in FIG. 3 is a phone card 12 which is printed within a rectangular block in an intermediate zone of the card so as not to block out the 2 and the spade symbol above and below the block.

Printed within the block is the same information contained in a conventional prepaid phone card, such as the prepaid amount ($3) the toll-free 800 number to be dialed (Dial 1-800-514-8997), and the card number to be entered when prompted (8544-265-2663).

The holder of the hybrid playing-phone card shown in FIG. 3 is therefore in possession of a prepaid phone card which he may put to use in the same manner as a conventional phone card. Thus the holder after having with a touch-tone phone dialed the 800 number, and then when prompted entered the card number, can then dial the party he wishes to call. Thus for a local call, he dials 1 plus the area code and the phone number.

Figure 4:
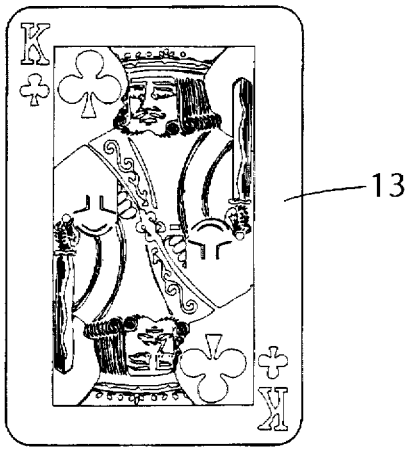
FIG. 4 shows the face of a king of clubs playing card taken from the same standard deck.
Figure 5:
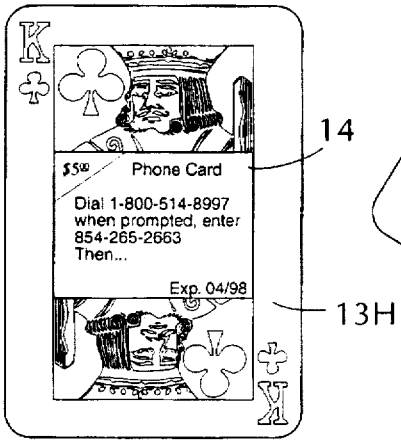
FIG. 5 shows a king of clubs card taken from the same hybrid deck.

FIG. 4 shows another card taken from the standard deck of playing cards, this card showing on its face 13 the king of clubs. The corresponding card in the hybrid deck is shown in FIG. 5, on whose face 13H is printed a phone card 14 having a $5 prepaid value, and appropriate dialing instructions.

The prepaid money value of each phone card in the hybrid deck of cards depends on the rank of the card in the deck, the higher the rank, the greater the value. Thus the ranking arrangement may be such that all number cards 2 to 8 in the hybrid deck have a $3 phone card value, all picture cards (king, queen, jack) have a five dollar value, all number 10 cards have a 7 dollar value and all Ace cards, a 10 dollar value.

The ranking of the cards and the prepaid values given thereto need not be in accordance with the above example, and may be otherwise arranged to satisfy particular requirements. Thus if the game is intended for adult players prepared to play for higher stakes, the top ranking card in the deck may have a $50 phone card value, and the lowest ranking card a $5 phone card value.

In playing with these two decks of cards, the game is played with the standard deck of playing cards in which a limited number of cards (say five to ten cards) in the standard deck are replaced by corresponding cards taken from the hybrid deck. Those standard cards for which hybrid cards are substituted are saved for reuse in subsequent games.

Figure 6:
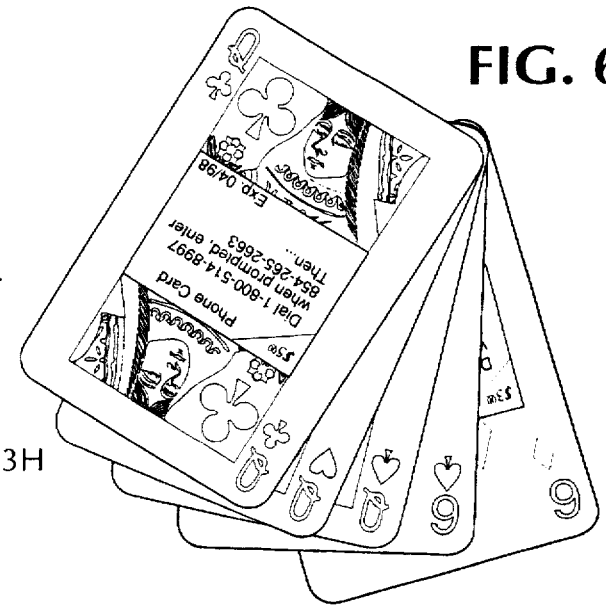
FIG. 6 shows a winning hand of cards, two of which are hybrid cards.

Thus available for playing in any competitive playing card game having two or more players is a standard deck of cards in which some of the cards are hybrid playing-phone cards. At the conclusion of the game, the winner gets to keep those cards on his winning hand which are playing-phone cards. Thus FIG. 6 shows a winning hand formed by three queens (clubs, hearts and spades) and two 6's (diamonds and clubs). The 6 of Diamonds in a playing-phone card as is the queen of clubs, all other cards in the hand being standard cards. Hence the winner removes the playing-phone cards from his winning hand, and replaces these cards with the corresponding standard cards previously removed from the standard deck.

Thus at the end of each game, one is left with a full deck of 52 standard playing cards, and a hybrid deck of less then 52 cards, for some of these cards are now in the possession of the winner of the game. To play another game, one again substitutes for some of the playing cards in the standard deck a like number of corresponding cards taken from the hybrid deck. A point will of course be reached where the playing-phone cards in the hybrid deck are exhausted. Then one must purchase from the company which produces and sells pre-paid phone cards a fresh deck of hybrid cards.

It is not essential to the invention that the hybrid deck contain a full deck of cards corresponding to the cards in the standard deck. Thus one may omit from the hybrid deck these cards corresponding to standard cards bearing the numbers 2 to 9.

While there has been shown a preferred embodiment of a card playing game using standard playing cards mixed with player-phone cards in accordance with the invention, will to be appreciated that many changes may be made therein without departing from the spirit of the invention. Thus instead of hybrid cards in which a phone card is integrated with a playing card, integrated with the playing card is a trade card having a specified value to create a playing-trade card. The trade card could be a cents-off discount coupon entitling the holder of the card to a discount on a particular supermarket product, or the trade card could be a coupon entitling the holder to a reduced rate in a restaurant or hotel.

I claim:

1. A playing card game whose winner gains free phone calling time, said game comprising:

A. a standard deck of playing cards; and

B. a deck of hybrid cards, each card of which corresponds to a card in the standard deck and has integrated therewith a prepaid phone card to form a playing-phone card whereby to play the game, some cards in the standard deck are replaced by corresponding hybrid cards, and the winner of the game keeps the playing-phone cards included in his winning hand.

2. A game as set forth in claim 1, in which the standard deck is constituted by 52 cards divided into four suits.

3. A game as set forth in claim 2, in which the hybrid deck is divided into four suits, each card of which has a rectangular block within which is printed the phone card.

4. A game as set forth in claim 3, in which each phone card includes a toll-free number to be dialed, and a card number to be entered when prompted.

5. A game as set forth in claim 3, in which the rectangular block is perforated so that it may be removed form the hybrid card.

6. A game as set forth in claim 3, in which printed on the phone card is the prepaid money value thereof.

7. A game as set forth in claim 6, in which the prepaid money value depends on the rank of the card in the deck, the highest value being given to the card having the highest rank.

8. A playing card game comprising:

A. a standard deck of playing cards; and

B. a deck of hybrid cards, each card of which corresponds to a card in the standard deck and has integrated therewith a trade card having a specified value to form a playing-trade card whereby to play the game, some cards in the standard deck are replaced by corresponding hybrid cards, and the winner of the game keeps the playing-trade cards included in his winning hand.

* * * * *